US005400231A

United States Patent [19]

Huang

[11] Patent Number: 5,400,231

[45] Date of Patent: Mar. 21, 1995

[54] COMBINATION SEARCHLIGHT

[76] Inventor: Ming-Chou Huang, No. 16, Lane 43, Hua Cheng Rd., Hsin Chuang, Taipei Hsien, Taiwan, Prov. of China

[21] Appl. No.: 246,707

[22] Filed: May 20, 1994

[51] Int. Cl.[6] ..... F21V 33/00; F21L 15/12

[52] U.S. Cl. ..... 362/253; 362/186; 362/294; 362/389; 362/399; 362/198; 362/455

[58] Field of Search ..... 362/253, 186, 294, 376, 362/389, 399, 457, 206, 198, 455

[56] References Cited

U.S. PATENT DOCUMENTS

| | | | |
|---|---|---|---|
| 3,809,321 | 5/1974 | Rundberg | 362/184 |
| 4,446,509 | 5/1984 | Thomas | 362/253 |
| 4,949,077 | 8/1990 | Mbuthia | 362/253 |
| 5,142,458 | 8/1992 | Brunson | 362/184 |

FOREIGN PATENT DOCUMENTS

| | | | |
|---|---|---|---|
| 702336 | 1/1954 | United Kingdom | 362/198 |

*Primary Examiner*—Ira S. Lazarus
*Assistant Examiner*—L. Heyman
*Attorney, Agent, or Firm*—Jacobson, Price, Holman & Stern

[57] ABSTRACT

A combination searchlight, which includes a searchlight, which has a lamp case covered with a rim and a lens and connected to a lamp case supporting arm thereof at the top of a handle thereof, a carrying strap fixed to the handle and lamp case supporting arm of the searchlight, and a mount fixed to the lamp case supporting arm to carry a compass and a reflecting bar, wherein the rim is fastened to the lamp case through a screw joint and has a plurality of pins perpendicularly extended from the front side thereof and spaced around the periphery for protecting the lens.

4 Claims, 3 Drawing Sheets

COMBINATION SEARCHLIGHT

BACKGROUND OF THE INVENTION

The present invention relates to a combination searchlight which comprises a carrying strap fixed to the handle thereof at one side, and a mount at the top to carry a compass and a reflecting bar. The rim of the lamp case of the searchlight has a plurality of pins perpendicularly extended from the front side thereof and spaced around the periphery for protecting the lens.

FIG. 4 shows a conventional searchlight, which is generally comprised of a lamp case 9, a rim 91 fastened to the lamp case 9 at the front to hold a lens 911, a supporting arm 92 longitudinally connected to the lamp case 9 at the back, a handle 93 perpendicularly connected to the supporting arm 92 a cable 94 inserted through the handle 93 and the supporting arm 92 to connect the lamp socket inside the lamp case 9 to a battery box, wherein the outside surface of the lens 911 is disposed approximately in flush with the front side 912 of the rim 91. This arrangement will cause certain problems. This structure of searchlight has numerous drawbacks as outlined hereinafter.

i) when the rim 91 is attached to the ground, the heat produced by the lamp bulb inside the lamp case 9 cannot be dissipated, causing the lens 911 melted or deformed if the lamp case 9 is placed in a rubber boat, the body of the boat will be melted or damaged).

ii) The lens 911 may be damaged easily when the rim 91 hits or touches the ground.

iii) The light of the lamp bulb of the searchlight will be blocked up when the rim 91 is attached to the ground, and therefore the user cannot make sure if the searchlight has been turned on or not.

iv) Because the rim 91 and the lamp case 9 are fastened tight to seal out water, it is difficult to remove the rim 91 from the lamp case 9.

v) When in use, the user must hold the handle 93 firmly in the hand, and therefore the user will have an aching muscles for holding the handle 93 for some times.

vi) While finding a direction, the user may be to carry a compass with the other hand.

SUMMARY OF THE INVENTION

The present invention has been accomplished to provide a combination searchlight which eliminates the aforesaid drawbacks.

According to one aspect of the present invention, the searchlight comprises a lamp case covered with a rim and a lens to hold a lamp socket and a lamp bulb, a supporting arm longitudinally connected to the lamp case at the back, and a handle perpendicularly extended from the supporting arm, wherein the rim is fastened to the Lamp case through a screw joint, having a plurality of pins longitudinally extended from the front side thereof and spaced around the periphery for protecting the lens. When the lamp case is placed on the ground, the rim is spaced above the ground by the pins. With the pins as points of force against the ground or an uneven surface, the rim can be easily removed from the lamp case by turning the handle.

According to another aspect of the present invention, a carrying strap is provided having one end fixed to the handle and an opposite end fixed to the supporting arm. Therefore, the user can carry the searchlight by holding the carrying strap in the hand leaving the fingers of the hand free for holding things or doing other jobs.

According to still another aspect of the present invention a mount is fixed to the supporting arm to carry a compass. By means of the guide of the compass, the user can find the direction while searching.

According to still another aspect of the present invention, the mount has a front projecting wall upwardly backwards extended from the front side thereof to hold a reflecting bar. Therefore, the reflecting bar reflects light onto the compass at night.

DETAILED DESCRIPTION OF THE PREFERRED EMBODIMENT

Figure 1:
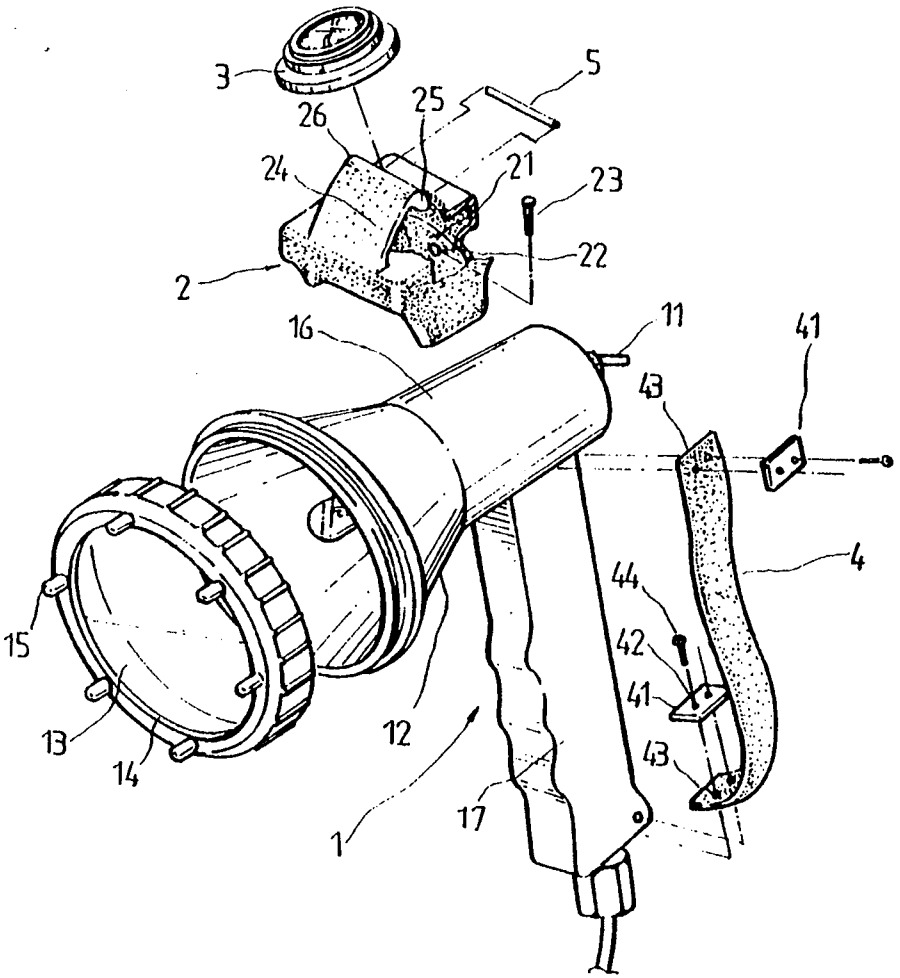
FIG. 1 is an exploded view of a combination searchlight according to the present invention.

Referring to FIG. 1, a combination searchlight in accordance with the present invention is generally comprised of a searchlight 1, a mount 2, a compass 3, a carrying strap 4, and a reflecting bar 5.

The searchlight 1 comprises a supporting arm 16, a handle 17 perpendicularly extended from the supporting arm 16, a lamp case 12 connected to the supporting arm 16 at the front, a rim 14 fastened to the lamp case 12 at the front through a screw joint to hold a lens 13. There is a power switch 11 mounted on the supporting arm 16 at the back for controlling the operation of the lamp bulb inside the lamp case 12. The rim 14 has a plurality of pins 15 raised from the front side thereof and spaced around the periphery. The compass 3 is mounted on the mount 2 at the top. The mount 2 comprises an arched bottom groove 91 fitting over the supporting arm 16, a plurality of screw holes 22 connected to respective screws holes (not shown) on the supporting arm 16 by screws 23, a front projecting wall 24 upwardly backwards extended from the front side thereof over the compass 3 and terminating in a transverse supporting strip 25. The supporting strip 25 has two pin holes 26 for mounting the reflecting bar 5. The carrying strap 4 has two pads 41 at two opposite ends thereof respectively fixed to the handle 17 and the supporting arm 16. By threading screws 44 into respective screw holes 42 on the pads 41 and respective through holes 43 on either end of the carrying strap 4 and respective screw holes (not shown) on the handle 17 or the supporting arm 16, the carrying strap 4 is fixed to the searchlight 1. By means of the carrying strap 4, the searchlight 1 can be hung on the hand or the shoulder.

Figure 2:
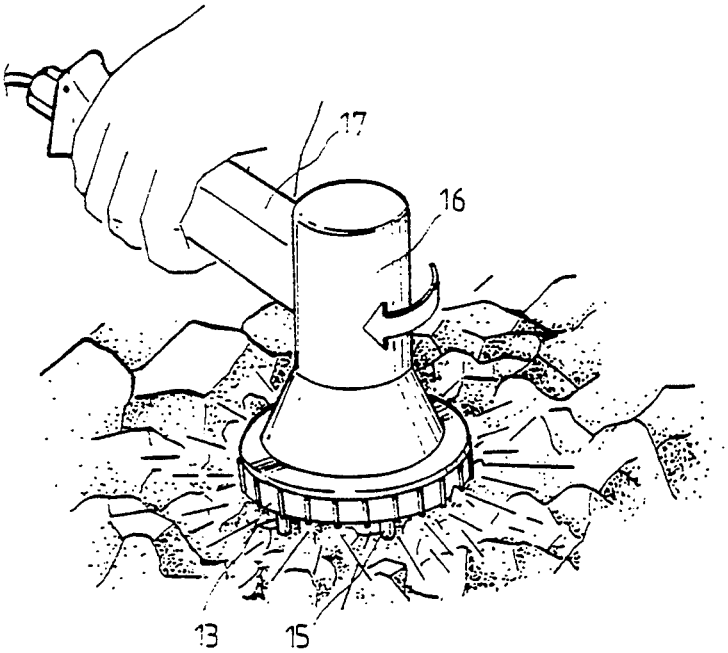
FIG. 2 is an applied view of the present invention, showing the rim of the lamp case of the combination searchlight spaced above the ground by the pins thereof.

Referring to FIG. 2, when the lamp case 12 is placed on the ground or seabed, the rim 14 is spaced above the ground or seabed by the pins 15 for letting air or water to pass through the gap in carrying heat away. The arrangement of the pins 15 also protects the lens 13 from hitting the ground or seabed. Through the gap between the rim 14 and the ground or seabed, the light of the lamp bulb inside the lamp case 12 is sent to the outside. Furthermore, the rim 14 can be easily removed from the lamp case 12 by stopping the pins 15 in the ground or an uneven surface and then turning the handle 17.

Figure 3:
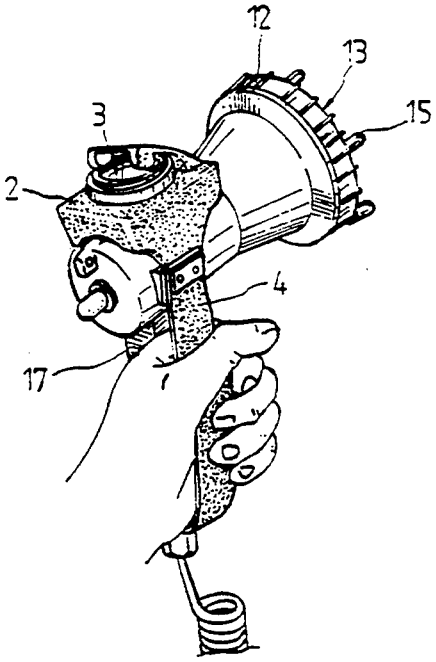
FIG. 3 is another applied view of the present invention, showing the carrying strap held in the hand.
Figure 4:
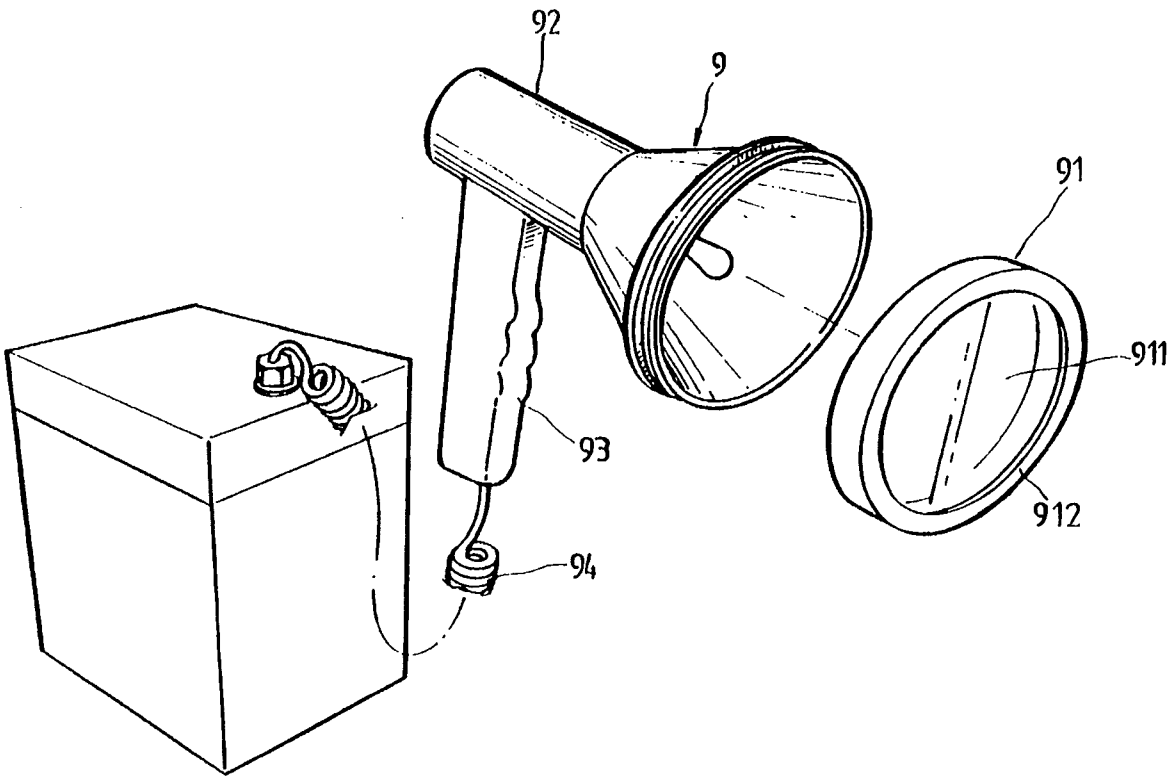
FIG 4 (PRIOR ART)
FIG. 4 shows a prior art searchlight.

Referring to FIG. 3, the user may carry the searchlight 1 by holding the carrying strap 4 so that the user can still use the fingers to hold other small things or to do other jobs. By means of the guide of the compass 3 on the mount 2, the user can easily find the correct direction. Because the compass 3 is mounted on the mount 2, the user needs not to hold the compass 3 with the other hand.

As indicated, the present invention provides a combination searchlight which combines a compass and a searchlight together so that the user can find the direction while searching. The arrangement of the pins on the rim protects the lens against damage and allows the rim to be conveniently removed from the lamp case.

While only one embodiment of the present invention has been shown and described, it will be understood that various modifications and changes could be made without departing from the spirit and scope of the invention.

What is claimed is:

1. A searchlight comprising:

a lamp case shaped like a hollow, truncated cone to hold a lamp socket and a lamp bulb on the inside, having an outer thread around a front end thereof;

a supporting arm having a front end longitudinally connected to said lamp case and a rear end mounted with a power switch electrically connected to said lamp socket inside said lamp case for controlling the operation of said lamp bulb;

a handle perpendicularly extended from said supporting arm; and a sealed rim assembly covered on said lamp case, said sealed rim assembly comprising a rim having an inner thread threaded with said outer thread of said lamp case and a plurality of pins perpendicularly extended from a front side thereof and spaced around the periphery, and a lens mounted inside said rim and covered on said lamp case.

2. The searchlight of claim 1 further comprising a carrying strap having one end fixed to said handle and an opposite end fixed to said supporting arm

3. The searchlight of claim 1 further comprising a mount fixed to said supporting arm and a compass mounted on said mount.

4. The searchlight of claim 3 wherein said mount a front projecting wall upwardly backwards extended from a front side thereof over said compass and terminating in a transverse supporting strip, said transverse supporting strip having a reflecting bar mounted thereon for reflecting light onto said compass.

* * * * *